US009869202B2

(12) United States Patent
Lutjen et al.

(10) Patent No.: US 9,869,202 B2
(45) Date of Patent: Jan. 16, 2018

(54) BLADE OUTER AIR SEAL FOR A GAS TURBINE ENGINE

(71) Applicant: United Technologies Corporation, Farmington, CT (US)

(72) Inventors: Paul M. Lutjen, Kennebunkport, ME (US); Carson A. Roy Thill, South Berwick, ME (US); Dominic J. Mongillo, Jr., West Hartford, CT (US); Kevin D. Tracy, Saco, ME (US); Jeffrey A. Perry, Sanford, ME (US); Thurman C. Dabbs, Dover, NH (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 329 days.

(21) Appl. No.: 14/826,498

(22) Filed: Aug. 14, 2015

(65) Prior Publication Data

US 2017/0044931 A1 Feb. 16, 2017

(51) Int. Cl.
*F01D 25/12* (2006.01)
*F01D 11/08* (2006.01)

(52) U.S. Cl.
CPC ..... *F01D 25/12* (2013.01); *F01D 11/08* (2013.01); *F05D 2220/32* (2013.01); *F05D 2240/11* (2013.01); *F05D 2240/24* (2013.01); *F05D 2250/74* (2013.01); *F05D 2260/20* (2013.01)

(58) Field of Classification Search
CPC ..... F01D 25/12; F01D 11/005; F01D 11/08; F01D 5/225; F05D 2250/74
See application file for complete search history.

(56) References Cited

U.S. PATENT DOCUMENTS

| | | | | |
|---|---|---|---|---|
| 6,340,285 | B1 * | 1/2002 | Gonyou | F01D 11/005 415/116 |
| 6,354,795 | B1 * | 3/2002 | White | F01D 11/24 415/116 |
| 2013/0323032 | A1 * | 12/2013 | Lutjen | F04D 29/164 415/173.1 |
| 2016/0201467 | A1 | 7/2016 | Milligan et al. | |

FOREIGN PATENT DOCUMENTS

| | | |
|---|---|---|
| EP | 1162346 | 12/2001 |
| EP | 1176285 | 1/2002 |
| EP | 2492454 | 8/2012 |

OTHER PUBLICATIONS

European Search Report issued in EP Application No. 16 18 4227; dated Dec. 13, 2016; 7 pages.

* cited by examiner

*Primary Examiner* — Woody Lee, Jr.
*Assistant Examiner* — Hoon Choi
(74) *Attorney, Agent, or Firm* — Cantor Colburn LLP

(57) ABSTRACT

A gas turbine engine includes a turbine section including a plurality of blade outer air seals (BOAS) disposed therein, the BOAS including a BOAS body including a plurality of cooling holes defined in substantial conformance with a set of Cartesian coordinates as set forth in at least one of Table 1 and Table 2.

20 Claims, 4 Drawing Sheets

BLADE OUTER AIR SEAL FOR A GAS TURBINE ENGINE

BACKGROUND

The present disclosure relates to blade outer air seals (BOAS) for gas turbine engines more particularly to BOAS for gas turbine engines with cooling holes defined therein.

Blade outer air seals (BOAS) can be disposed in turbine sections of turbomachines for sealing the gap between a turbine blade tip and the inner wall of the turbomachine casing. In such uses, the BOAS can be exposed to extreme heat and can require cooling.

Accordingly, it is desirable to provide adequate cooling to the BOAS.

BRIEF SUMMARY

According to one embodiment, a blade outer air seal (BOAS) for a gas turbine engine includes a BOAS body including a plurality of cooling holes defined in substantial conformance with a first set of Cartesian coordinates as set forth in Table 1, wherein the first set of Cartesian coordinates are provided with respect to a point $P_1$ which is at a center of curvature of an arc W of the BOAS body, wherein a Z axis of the first set of Cartesian coordinates is directed toward the center of a curvature of the arc W of the BOAS body and a Y axis of the first set of Cartesian coordinates is directed away from a surface T of the BOAS body, wherein a measurement $x_1$ in an X direction of the first set of Cartesian coordinates is normalized by a Y distance between a surface V of the BOAS body and a surface T of the BOAS body, wherein a measurement $y_1$ in a Y direction of the first set of Cartesian coordinates is normalized by the Y distance between the surface V of the BOAS body and the surface T of the BOAS body, and wherein a measurement $z_1$ in a Z direction of the first set of Cartesian coordinates is normalized by a radius of the curvature of the arc W of the BOAS body.

In addition to one or more of the features described above, or as an alternative, further embodiments could include that the surface T is a first surface of the BOAS body.

In addition to one or more of the features described above, or as an alternative, further embodiments could include that the surface V is a second surface of the BOAS body and is opposite the surface T of the BOAS body.

In addition to one or more of the features described above, or as an alternative, further embodiments could include that the arc W of the BOAS body is adjacent to the surface V.

In addition to one or more of the features described above, or as an alternative, further embodiments could include that the Y distance between a surface V of the BOAS body and a surface T of the BOAS body is between 36.6 mm to 40.6 mm.

In addition to one or more of the features described above, or as an alternative, further embodiments could include that the Y distance between a surface V of the BOAS body and a surface T of the BOAS body is between 37.5 mm to 37.9 mm.

In addition to one or more of the features described above, or as an alternative, further embodiments could include that the radius of the curvature of the arc W of the BOAS body is between 254.0 mm to 259.1 mm.

In addition to one or more of the features described above, or as an alternative, further embodiments could include that the radius of the curvature of the arc W of the BOAS body is between 257.8 mm and 258.6 mm.

According to one embodiment, a blade outer air seal (BOAS) for a gas turbine engine includes a BOAS body including a plurality of cooling holes defined in substantial conformance with a second set of Cartesian coordinates as set forth in Table 2, wherein the second set of Cartesian coordinates are provided with respect to a point $P_2$ which is at a center of curvature of an arc F of the BOAS body, wherein a Z axis of the second set of Cartesian coordinates is directed toward the center of a curvature of the arc F of the BOAS body and a Y axis of the second set of Cartesian coordinates is directed toward a surface G of the BOAS body, wherein a measurement $x_2$ in an X direction of the second set of Cartesian coordinates is normalized by a Y distance between a surface G of the BOAS body and a surface E of the BOAS body, wherein a measurement $y_2$ in a Y direction of the second set of Cartesian coordinates is normalized by the Y distance between the surface G of the BOAS body and the surface E of the BOAS body, and wherein a measurement $z_2$ in a Z direction of the second set of Cartesian coordinates is normalized by a radius of the curvature of the arc F of the BOAS body.

In addition to one or more of the features described above, or as an alternative, further embodiments could include that the surface E is a first surface of the BOAS body.

In addition to one or more of the features described above, or as an alternative, further embodiments could include that the surface G is a second surface of the BOAS body and is opposite the surface E of the BOAS body.

In addition to one or more of the features described above, or as an alternative, further embodiments could include that the arc of the BOAS body is adjacent to the surface G of the BOAS body.

In addition to one or more of the features described above, or as an alternative, further embodiments could include that the Y distance between the surface G of the BOAS body and the surface E of the BOAS body is between 30.5 mm to 33.0 mm.

In addition to one or more of the features described above, or as an alternative, further embodiments could include that the Y distance between the surface G of the BOAS body and the surface E of the BOAS body is between 31.3 mm to 31.6 mm.

In addition to one or more of the features described above, or as an alternative, further embodiments could include that the radius of the curvature of the arc F of the BOAS body is between 254.0 mm and 264.2 mm.

In addition to one or more of the features described above, or as an alternative, further embodiments could include that the radius of the curvature of the arc F of the BOAS body is between 258.8 mm and 259.5 mm.

According to one embodiment, a gas turbine engine includes a turbine section including a plurality of blade outer air seals (BOAS) disposed therein, the BOAS including a BOAS body including a plurality of cooling holes defined in substantial conformance with a set of Cartesian coordinates as set forth in at least one of Table 1 and Table 2.

In addition to one or more of the features described above, or as an alternative, further embodiments could include that the turbine section includes at least one BOAS having cooling holes defined in at accordance with Table 1, and at least one BOAS having cooling holes defined in at accordance with Table 2.

In addition to one or more of the features described above, or as an alternative, further embodiments could include that the at least one BOAS having cooling holes defined in at accordance with Table 1 is disposed in a first stage of the turbine section.

In addition to one or more of the features described above, or as an alternative, further embodiments could include that the at least one BOAS having cooling holes defined in at accordance with Table 2 is disposed in a second stage of the turbine section aft of the first stage.

Other aspects, features, and techniques of the embodiments will become more apparent from the following description taken in conjunction with the drawings.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
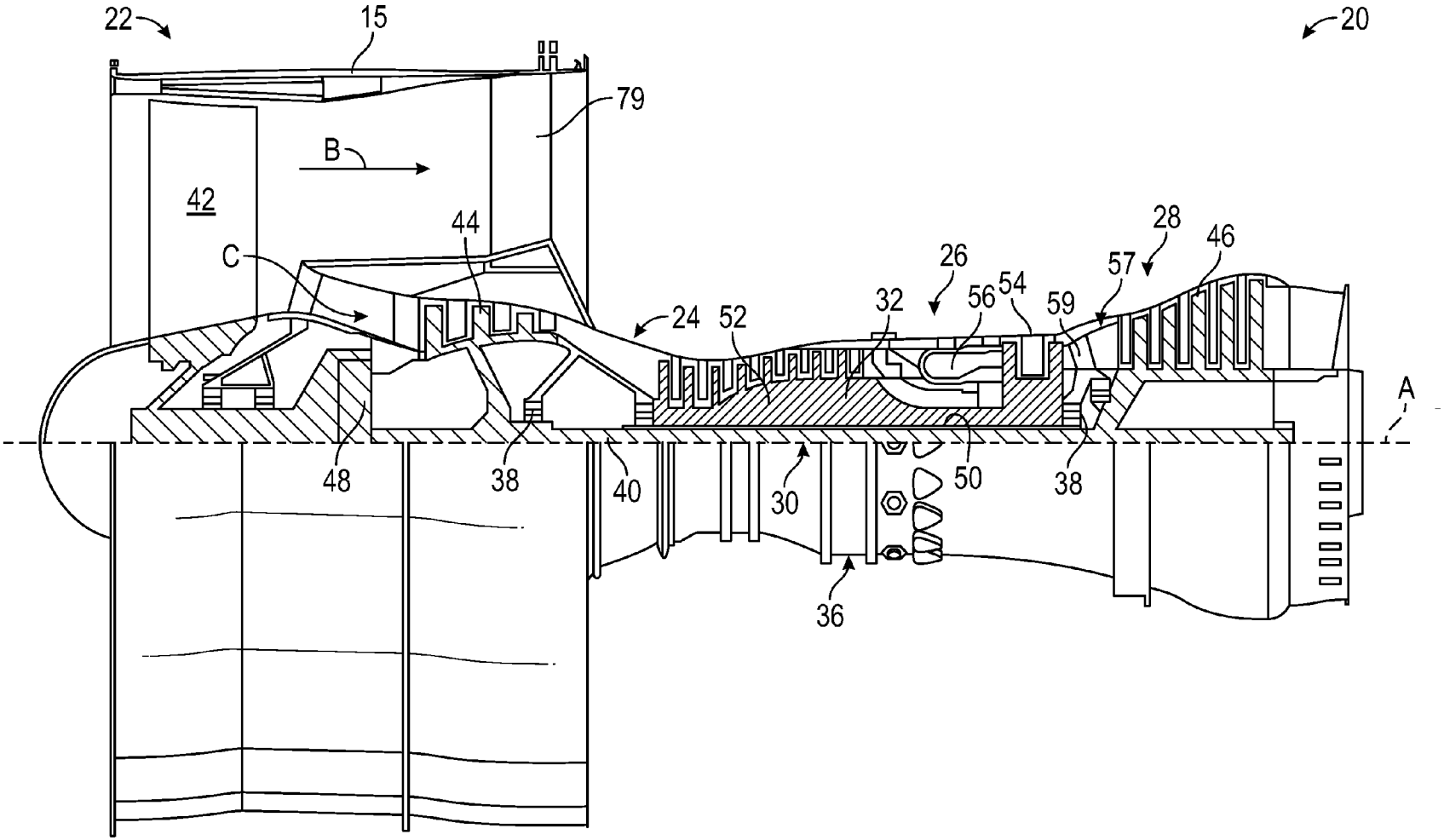
FIG. 1 is a schematic, partial cross-sectional view of a turbomachine in accordance with this disclosure.

Reference will now be made to the drawings wherein like reference numerals identify similar structural features or aspects of the subject disclosure. For purposes of explanation and illustration, and not limitation, an illustrative view of an embodiment of a blade outer air seal (BOAS) in accordance with the disclosure is shown in FIG. 2A and is designated generally by reference character 100. Other embodiments and/or aspects of this disclosure are shown in FIGS. 1, 2B, 3A, 3B, and 4. The systems and methods described herein can be used to provide enhanced cooling for BOAS.

Figure 2A:
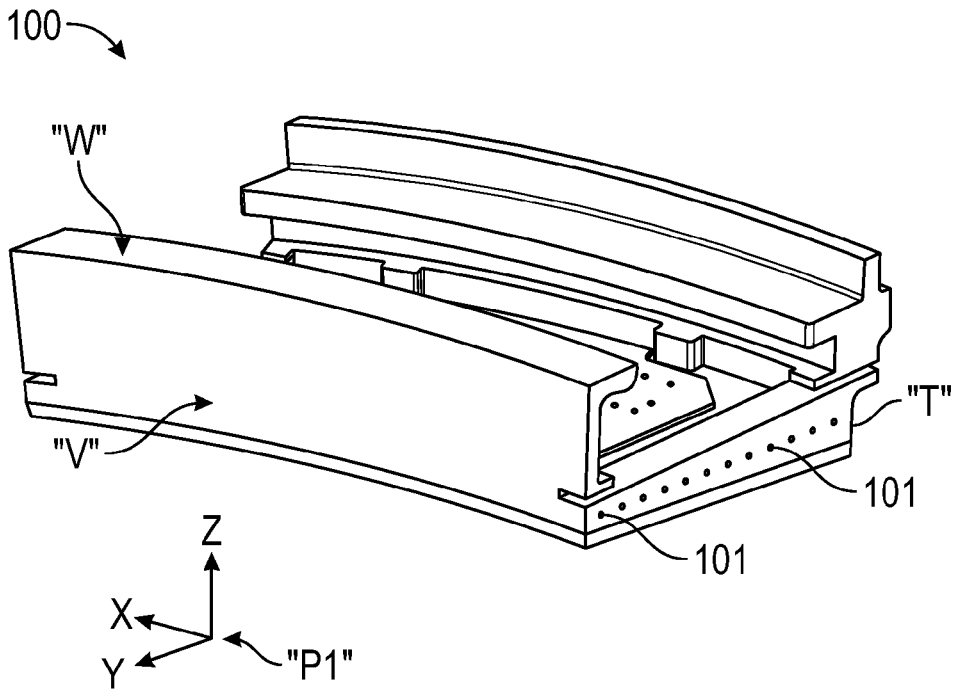
FIG. 2A is a perspective view of an embodiment of a blade outer air seal (BOAS) in accordance with this disclosure, showing cooling holes disposed therein.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28.

Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The illustrated engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in illustrated gas turbine engine 20 is illustrated as a gear system 100 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24 combustor section 26, turbine section 28 and fan gear system 100 may be varied. For example, gear system 100 may be located aft of combustor section 26 or even aft of turbine section 28, and fan section 22 may be positioned forward or aft of the location of gear system 100.

The engine 20 in one example is a high-bypass geared aircraft engine. In a further example, the engine 20 bypass ratio is greater than about six (6), with an example embodiment being greater than about ten (10), the geared architecture is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition— typically cruise at about 0.8 Mach and about 35,000 feet. The flight condition of 0.8 Mach and 35,000 ft (10,668 meters), with the engine at its best fuel consumption—also known as "bucket cruise Thrust Specific Fuel Consumption ('TSFC')"—is the industry standard parameter of 1 bm of fuel being burned divided by 1 bf of thrust the engine produces at that minimum point, "Low fan pressure ratio" is the pressure ratio across the fan blade alone, without a Fan Exit Guide Vane 79 ("FEGV") system. The low fan pressure ratio as disclosed herein according to one non-limiting embodiment is less than about 1.45. "Low corrected fan tip speed" is the actual fan tip speed in ft/sec divided by an industry standard temperature, correction of [(Tram °R)/(518.7°R)]^0.5. The "Low corrected fan tip speed" as disclosed herein according to one non-limiting embodiment is less than about 1.150 ft/second (350.5 meters/second).

Figure 2B:
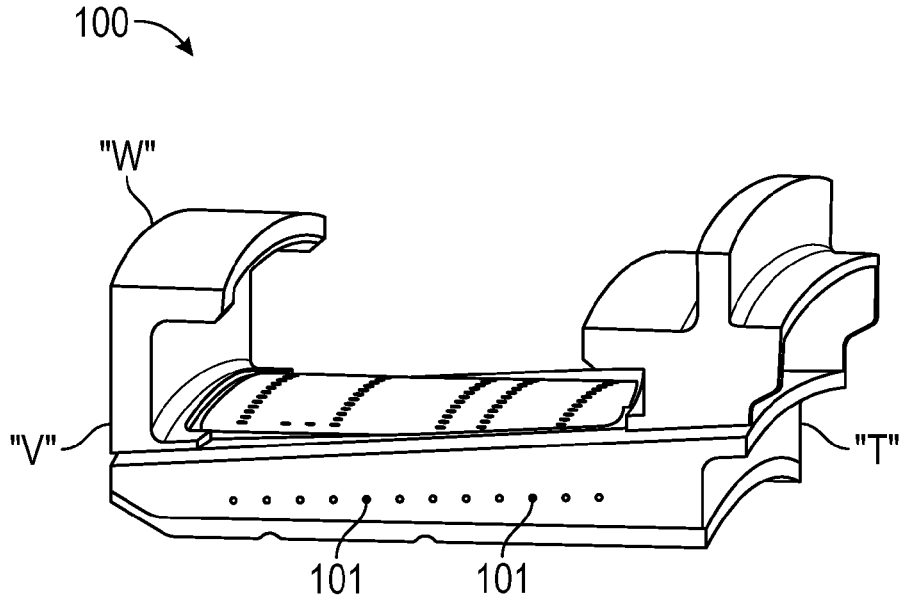
FIG. 2B is an alternative perspective view of the embodiment of the blade outer air seal shown in FIG. 2A.

Referring to FIGS. 2A and 2B, in accordance with an embodiment of this disclosure, a blade outer air seal (BOAS) 100 is shown. Leakage of flow-path air may occur in turbomachinery between the tips of a rotating blade structure and the outer static structure. The BOAS 100 can be used to provide a sealing relationship between a rotating turbomachine blade (e.g., a turbine blade) and a stationary component of a turbomachine to prevent flow from leaking around a tip of the turbomachine blade. The BOAS 100 can include cooling holes 101 having locations substantially as defined in the Cartesian coordinates of Table 1, produced below.

The BOAS 100 includes a first surface T, a second surface V opposite to the first surface T, and an arc W adjacent to the second surface V. All locations are provided with respect to a point $P_1$ (0,0,0) which is at the center of curvature of arc W of the BOAS 100 wherein the Z axis is directed toward the center of the arc W and the Y axis is directed away from the surface T, as shown in FIG. 2A. Measurements in the X direction are normalized by the Y distance between the surface V and the surface T. In certain embodiments, the Y distance between the surface V and the surface T can range from 1.4 inches to 1.6 inches (36.6 mm to 40.6 mm), in another embodiment, the Y distance can range from 1.475 inches to 1.491 inches (37.5 mm to 37.9 mm). Measurements in the Y direction are normalized by the Y distance between the surface V and the surface T. Measurements in the Z direction are normalized by the radius of the curvature of the arc W. In certain embodiments, the radius of arc W can range from 10.0 inches to 10.2 inches (254.0 mm to 259.1 mm), in another embodiment, the radius of arc W can range 10.151 inches to 10.181 inches (257.8 mm to 258.6 mm).

The locations are presented in Table 1 in cold, coated, and stationary condition and are subject to change based on finishing of the BOAS 100. The coordinates are normalized. One having ordinary skill in the art will appreciate that new locations of cooling holes 101 relative to any suitable reference can be determined in any suitable manner based on the procedures involved in finishing the BOAS 100. Holes are located with included part tolerances and a hole true position of about 0.023 inches or 0.58 mm. Hole locations are designed to be between the minimum and maximum values provided in Table 1. As described herein, holes 101 can include any suitable cross-sectional shape, such as, but not limited to, circular, elliptical, and/or any other symmetric or non-symmetric shape.

TABLE 1

| Hole | $X_{min}$ | $X_{max}$ | $Y_{min}$ | $Y_{max}$ | $Z_{min}$ | $Z_{max}$ |
|---|---|---|---|---|---|---|
| 1 | −0.722 | −0.714 | −0.094 | −0.093 | 0.931 | 0.934 |
| 2 | −0.575 | −0.569 | −0.092 | −0.091 | 0.933 | 0.936 |
| 3 | −0.414 | −0.410 | −0.094 | −0.093 | 0.935 | 0.938 |

TABLE 1-continued

| Hole | $X_{min}$ | $X_{max}$ | $Y_{min}$ | $Y_{max}$ | $Z_{min}$ | $Z_{max}$ |
|---|---|---|---|---|---|---|
| 4 | −0.270 | −0.267 | −0.094 | −0.093 | 0.936 | 0.939 |
| 5 | −0.125 | −0.124 | −0.094 | −0.093 | 0.937 | 0.939 |
| 6 | 0.019 | 0.019 | −0.094 | −0.093 | 0.937 | 0.940 |
| 7 | 0.162 | 0.164 | −0.094 | −0.093 | 0.936 | 0.939 |
| 8 | 0.305 | 0.309 | −0.094 | −0.093 | 0.936 | 0.938 |
| 9 | 0.448 | 0.453 | −0.094 | −0.093 | 0.934 | 0.937 |
| 10 | 0.591 | 0.597 | −0.094 | −0.093 | 0.933 | 0.936 |
| 11 | 0.733 | 0.741 | −0.094 | −0.093 | 0.931 | 0.933 |
| 12 | −0.749 | −0.741 | −0.262 | −0.259 | 0.930 | 0.933 |
| 13 | −0.631 | −0.624 | −0.288 | −0.285 | 0.932 | 0.935 |
| 14 | −0.459 | −0.454 | −0.244 | −0.241 | 0.934 | 0.937 |
| 15 | −0.327 | −0.324 | −0.244 | −0.241 | 0.935 | 0.938 |
| 16 | −0.195 | −0.193 | −0.244 | −0.241 | 0.936 | 0.939 |
| 17 | −0.063 | −0.062 | −0.244 | −0.241 | 0.937 | 0.939 |
| 18 | 0.068 | 0.069 | −0.244 | −0.241 | 0.937 | 0.939 |
| 19 | 0.199 | 0.201 | −0.244 | −0.241 | 0.936 | 0.939 |
| 20 | 0.329 | 0.333 | −0.244 | −0.241 | 0.935 | 0.938 |
| 21 | 0.460 | 0.465 | −0.244 | −0.241 | 0.934 | 0.937 |
| 22 | 0.590 | 0.596 | −0.244 | −0.241 | 0.933 | 0.935 |
| 23 | 0.720 | 0.727 | −0.244 | −0.241 | 0.931 | 0.933 |
| 24 | −0.737 | −0.729 | −0.405 | −0.400 | 0.931 | 0.933 |
| 25 | −0.577 | −0.571 | −0.413 | −0.409 | 0.933 | 0.936 |
| 26 | −0.411 | −0.406 | −0.380 | −0.376 | 0.935 | 0.938 |
| 27 | −0.266 | −0.263 | −0.380 | −0.376 | 0.936 | 0.939 |
| 28 | −0.122 | −0.120 | −0.380 | −0.376 | 0.936 | 0.939 |
| 29 | 0.023 | 0.023 | −0.380 | −0.376 | 0.937 | 0.939 |
| 30 | 0.166 | 0.168 | −0.380 | −0.376 | 0.936 | 0.939 |
| 31 | 0.309 | 0.312 | −0.380 | −0.376 | 0.936 | 0.938 |
| 32 | 0.452 | 0.457 | −0.380 | −0.376 | 0.934 | 0.937 |
| 33 | 0.594 | 0.601 | −0.380 | −0.376 | 0.933 | 0.935 |
| 34 | 0.737 | 0.745 | −0.380 | −0.376 | 0.930 | 0.933 |
| 35 | −0.750 | −0.742 | −0.521 | −0.515 | 0.930 | 0.933 |
| 36 | −0.652 | −0.645 | −0.524 | −0.519 | 0.932 | 0.935 |
| 37 | 0.736 | 0.744 | −0.493 | −0.487 | 0.930 | 0.933 |
| 38 | −0.777 | −0.769 | −0.179 | −0.177 | 0.940 | 0.943 |
| 39 | −0.777 | −0.769 | −0.240 | −0.237 | 0.940 | 0.943 |
| 40 | −0.777 | −0.769 | −0.289 | −0.286 | 0.940 | 0.943 |
| 41 | −0.777 | −0.769 | −0.350 | −0.346 | 0.940 | 0.943 |
| 42 | −0.777 | −0.769 | −0.398 | −0.394 | 0.940 | 0.943 |
| 43 | −0.777 | −0.769 | −0.467 | −0.462 | 0.940 | 0.943 |
| 44 | −0.777 | −0.769 | −0.551 | −0.545 | 0.940 | 0.943 |
| 45 | −0.777 | −0.769 | −0.630 | −0.623 | 0.940 | 0.943 |
| 46 | −0.777 | −0.769 | −0.708 | −0.700 | 0.940 | 0.943 |
| 47 | −0.779 | −0.771 | −0.757 | −0.749 | 0.942 | 0.945 |
| 48 | −0.779 | −0.771 | −0.845 | −0.836 | 0.942 | 0.945 |
| 49 | −0.779 | −0.771 | −0.949 | −0.939 | 0.942 | 0.945 |
| 50 | 0.771 | 0.779 | −0.915 | −0.905 | 0.942 | 0.945 |
| 51 | 0.771 | 0.779 | −0.804 | −0.795 | 0.942 | 0.945 |
| 52 | 0.769 | 0.777 | −0.669 | −0.662 | 0.940 | 0.943 |
| 53 | 0.769 | 0.777 | −0.591 | −0.584 | 0.940 | 0.943 |
| 54 | 0.769 | 0.777 | −0.512 | −0.507 | 0.940 | 0.943 |
| 55 | 0.769 | 0.777 | −0.429 | −0.424 | 0.940 | 0.943 |
| 56 | 0.769 | 0.777 | −0.319 | −0.316 | 0.940 | 0.943 |
| 57 | 0.769 | 0.777 | −0.209 | −0.207 | 0.940 | 0.943 |
| 58 | 0.769 | 0.777 | −0.097 | −0.096 | 0.940 | 0.943 |

Figure 3A:
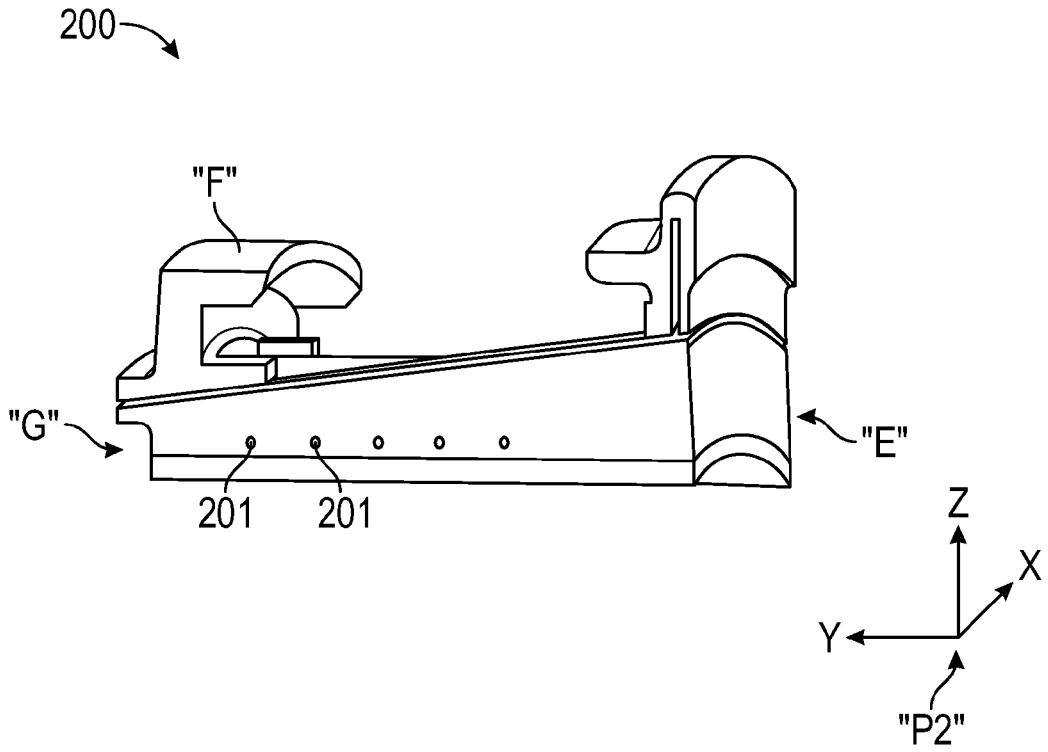
FIG. 3A is a perspective view of an embodiment of a blade outer air seal (BOAS) in accordance with this disclosure, showing cooling holes disposed therein.
Figure 3B:
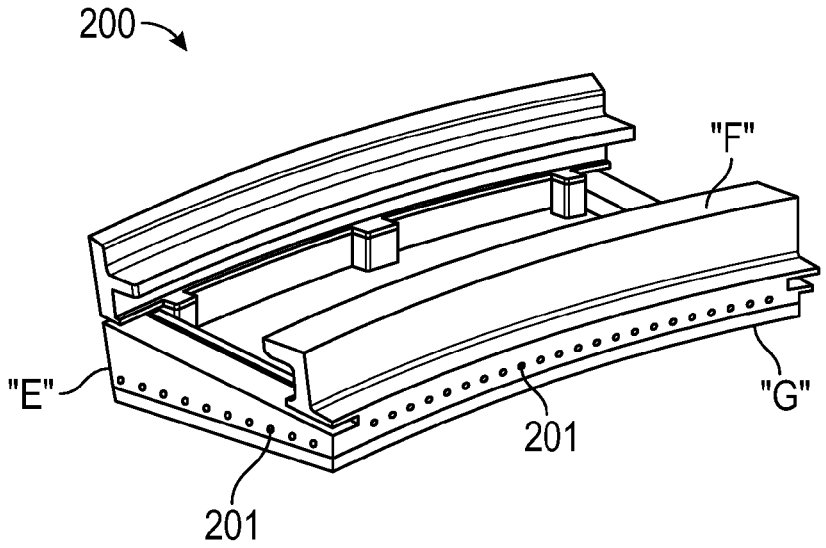
FIG. 3B is an alternative perspective view of the embodiment of the blade outer air seal shown in FIG. 3A.

In accordance with another embodiment of this disclosure, referring to FIGS. 3A and 3B, a BOAS 200 can include cooling holes 201 having locations substantially as described in the Cartesian coordinates of Table 2, produced below. The BOAS 200 includes a first surface E, a second surface G opposite to the first surface E, and an arc F adjacent to the second surface G. All locations are provided with respect to a point $P_2$ (0,0,0) which is at the center of curvature of arc F of the BOAS 200 wherein the Z axis is directed toward the center of the arc F and the Y axis is directed toward the surface G, as shown in FIG. 3A. Measurements in the X direction are normalized by the Y distance between the surface G and the surface E. In certain embodiments, the Y distance between the surface G and the surface E can range from 1.2 inches to 1.3 inches (30.5 mm to 33.0 mm), more specifically from 1.234 inches to 1.246 inches (31.3 mm to 31.6 mm). Measurements in the Y direction are normalized by the Y distance between the surface G and the surface E. Measurements in the Z direction are normalized by the radius of the curvature of the arc F. In certain embodiments, the radius of arc F can range from 10.0 inches to 10.4 inches (254.0 mm to 264.2 mm), more specifically from 10.187 inches to 10.217 inches (258.8 mm to 259.5 mm).

The locations are presented in Table 2 in cold, coated, and stationary condition and are subject to change based on finishing of the BOAS 200. The coordinates are normalized. One having ordinary skill in the art will appreciate that new locations of cooling holes 201 relative to any suitable reference can be determined in any suitable manner based on the procedures involved in finishing the BOAS 200. Holes are located with included part tolerances and a hole true position of about 0.023 inches or 0.58 mm. Hole locations are designed to be between the minimum and maximum values provided in Table 2. As described herein, holes 201 can include any suitable cross-sectional shape, such as, but not limited to, circular, elliptical, and/or any other symmetric or non-symmetric shape.

TABLE 2

| Hole | $X_{min}$ | $X_{max}$ | $Y_{min}$ | $Y_{max}$ | $Z_{min}$ | $Z_{max}$ |
|---|---|---|---|---|---|---|
| 1 | −0.891 | −0.876 | 1.000 | 1.000 | 0.954 | 0.957 |
| 2 | −0.802 | −0.788 | 1.000 | 1.000 | 0.955 | 0.958 |
| 3 | −0.603 | −0.591 | 1.000 | 1.000 | 0.957 | 0.960 |
| 4 | −0.403 | −0.393 | 1.000 | 1.000 | 0.959 | 0.962 |
| 5 | −0.203 | −0.195 | 1.000 | 1.000 | 0.960 | 0.962 |
| 6 | −0.003 | 0.003 | 1.000 | 1.000 | 0.960 | 0.963 |
| 7 | 0.195 | 0.203 | 1.000 | 1.000 | 0.960 | 0.962 |
| 8 | 0.393 | 0.403 | 1.000 | 1.000 | 0.959 | 0.962 |
| 9 | 0.591 | 0.603 | 1.000 | 1.000 | 0.957 | 0.960 |
| 10 | 0.788 | 0.802 | 1.000 | 1.000 | 0.955 | 0.958 |
| 11 | 0.876 | 0.891 | 1.000 | 1.000 | 0.954 | 0.957 |
| 12 | 0.930 | 0.946 | 0.871 | 0.879 | 0.953 | 0.956 |
| 13 | 0.930 | 0.946 | 0.755 | 0.762 | 0.953 | 0.956 |
| 14 | 0.930 | 0.946 | 0.639 | 0.645 | 0.953 | 0.956 |
| 15 | 0.930 | 0.946 | 0.523 | 0.528 | 0.953 | 0.956 |
| 16 | 0.930 | 0.946 | 0.407 | 0.411 | 0.953 | 0.956 |
| 17 | −0.946 | −0.930 | 0.349 | 0.353 | 0.953 | 0.956 |
| 18 | −0.946 | −0.930 | 0.465 | 0.470 | 0.953 | 0.956 |
| 19 | −0.946 | −0.930 | 0.581 | 0.587 | 0.953 | 0.956 |
| 20 | −0.946 | −0.930 | 0.697 | 0.704 | 0.953 | 0.956 |
| 21 | −0.946 | −0.930 | 0.813 | 0.821 | 0.953 | 0.956 |

Figure 4:
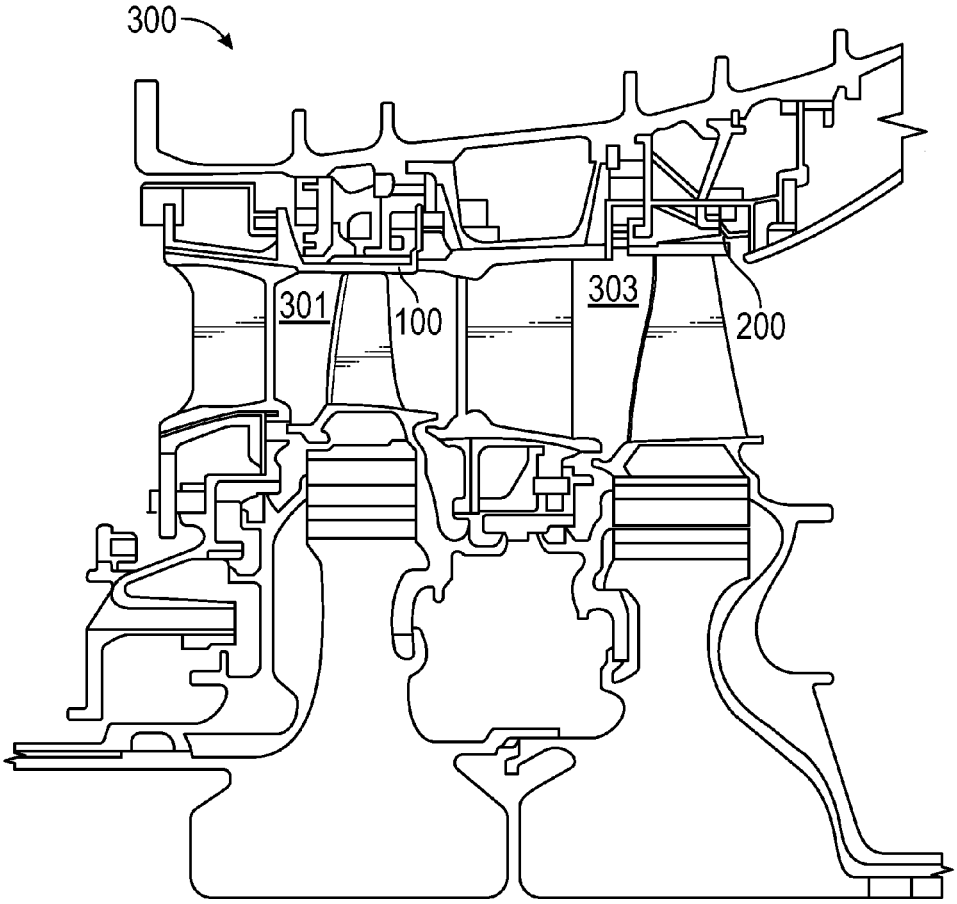
FIG. 4 is a cross-sectional view a turbomachine turbine section in accordance with this disclosure, showing a plurality of BOAS cooling holes disposed therein.

Referring to FIG. 4, a turbomachine can include a turbine section 300 including a plurality of blade outer air seals (BOAS) 100 and/or 200 as described above including cooling holes 101 and/or 201 having locations as set forth in Table 1 and/or Table 2. In certain embodiments, the turbine section 300 can include at least one BOAS 100 having cooling holes defined in accordance with Table 1 and at least one BOAS 200 having cooling holes defined in accordance with Table 2. In certain embodiments, the at least one BOAS 100 having cooling holes 101 defined in accordance with Table 1 can be disposed in a first stage 301 of the turbine section 300. The at least one BOAS 200 having cooling holes 201 defined in accordance with Table 2 can be disposed in a second stage 303 of the turbine section 300 which is aft of the first stage 301.

A substantially conforming BOAS structure has cooling holes that conform to the specified sets of points, within a specified tolerance of true position as described above.

Alternatively, substantial conformance is based on a determination by a national or international regulatory body, for example in a part certification or part manufacture approval (PMA) process for the Federal Aviation Administration, the European Aviation Safety Agency, the Civil Aviation Administration of China, the Japan Civil Aviation Bureau, or the Russian Federal Agency for Air Transport. In these configurations, substantial conformance encompasses a determination that a particular part or structure is identical to, or sufficiently similar to, the specified airfoil, blade, or vane, or that the part or structure is sufficiently the same with respect to a part design in a type-certified or type-certificated BOAS, such that the part or structure complies with airworthiness standards applicable to the specified blade, vane or airfoil. In particular, substantial conformance encompasses any regulatory determination that a particular part or structure is sufficiently similar to, identical to, or the same as a specified BOAS, such that certification or authorization for use is based at least in part on the determination of similarity.

Figure 5:
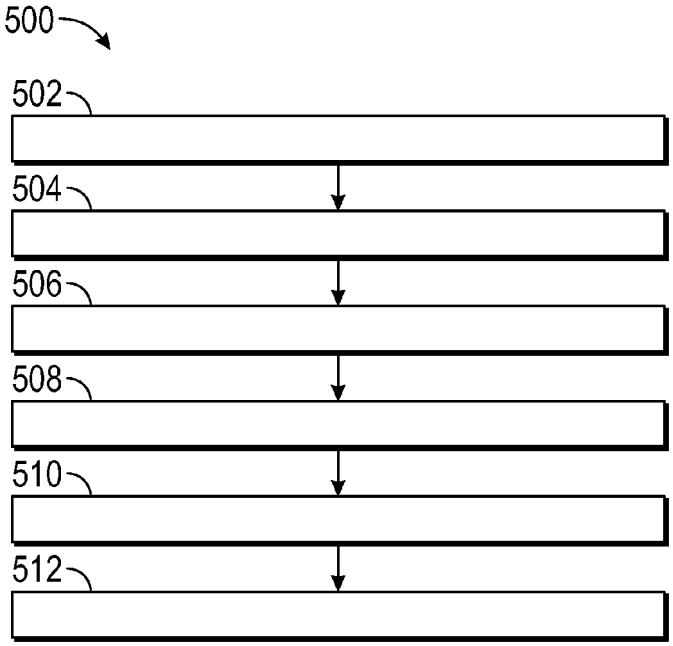
FIG. 5 is a flow chart depicting a method of cooling BOAS of a gas turbine engine in accordance with an embodiment of the disclosure.

Referring now to FIG. 5, a method for cooling the BOAS of a gas turbine engine is illustrated by a flow chart 500. As mentioned above, a BOAS is located in turbine sections of turbomachines such as gas turbine engines for sealing the gap between the turbine blade tip and the inner wall of the turbomachine casing. The BOAS may contain cooling holes. In one non-limiting embodiment, the BOAS can include a plurality of cooling holes in substantial conformance with the set of Cartesian coordinates set forth in Table 1. In other embodiments, the BOAS can include a plurality of cooling holes in substantial conformance with the set of Cartesian coordinates set forth in Table 2.

As mentioned above, a gas turbine engine can include a first turbine section with a BOAS with a plurality of cooling holes in substantial conformance with the set of Cartesian coordinates set forth in Table 1, and a second turbine section a plurality of cooling holes in substantial conformance with the set of Cartesian coordinates set forth in Table 2.

During operation of the turbine engine, airflow is introduced to a first turbine section of the turbine engine. This is illustrated by box or step 502. During operation, the first turbine section allows for the airflow to expand through the first turbine section. Wherein the first turbine section and BOAS of the first turbine section may experience high temperatures.

Further, the BOAS of the first turbine section seals the gap between the turbine blade tips and the inner wall of the turbomachine casing, allowing for desired performance. This is illustrated by box or step 504. Accordingly, the BOAS allows for the airflow to expand through the first turbine section instead of migrating through the gap between the turbine blade tips and the inner wall of the turbomachine casing.

During sealing operations, the BOAS of the first turbine section receive bypass airflow from the gas turbine engine via the cooling holes of the BOAS. This is illustrated by box or step 506. By receiving bypass airflow within the cooling holes, the BOAS of the first turbine section can transfer heat away during operation.

During operation of the turbine engine, airflow is introduced to a second turbine section of the turbine engine. This is illustrated by box or step 508. During operation, the second turbine section allows for the airflow to expand through the second turbine section, wherein the second turbine section and BOAS of the second turbine section may experience high temperatures.

Further, the BOAS of the second turbine section seals the gap between the turbine blade tips and the inner wall of the turbomachine casing, allowing for desired performance. This is illustrated by box or step 510. Accordingly, the BOAS allows for the airflow to expand through the second turbine section instead of migrating through the gap between the turbine blade tips and the inner wall of the turbomachine casing.

During sealing operations, the BOAS of the second turbine section receive bypass airflow from the gas turbine engine via the cooling holes of the BOAS. This is illustrated by box or step 512. By receiving bypass airflow within the cooling holes, the BOAS of the second turbine section can transfer heat away during operation.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A blade outer air seal (BOAS) for a gas turbine engine, comprising:

a BOAS body including a plurality of cooling holes defined in conformance with a first set of Cartesian coordinates as set forth in Table 1, wherein the first set of Cartesian coordinates are provided with respect to a point P1 which is at a center of curvature of an arc W of the BOAS body, wherein a Z axis of the first set of Cartesian coordinates is directed toward the center of a curvature of the arc W of the BOAS body and a Y axis of the first set of Cartesian coordinates is directed away from a surface T of the BOAS body, wherein a measurement x1 in an X direction of the first set of Cartesian coordinates is normalized by a Y distance between a surface V of the BOAS body and the surface T of the BOAS body, wherein a measurement y1 in a Y direction of the first set of Cartesian coordinates is normalized by the Y distance between the surface V of the BOAS body and the surface T of the BOAS body, and wherein a measurement z1 in a Z direction of the first set of Cartesian coordinates is normalized by a radius of the curvature of the arc W of the BOAS body.

2. The blade outer air seal (BOAS) of claim 1, wherein the surface T is a first surface of the BOAS body.

3. The blade outer air seal (BOAS) of claim 1, wherein the surface V is a second surface of the BOAS body and is opposite the surface T of the BOAS body.

4. The blade outer air seal (BOAS) of claim 1, wherein the arc W of the BOAS body is adjacent to the surface V.

5. The blade outer air seal (BOAS) of claim 1, wherein the Y distance between the surface V of the BOAS body and the surface T of the BOAS body is between 36.6 mm to 40.6 mm.

6. The blade outer air seal (BOAS) of claim 5, wherein the Y distance between the surface V of the BOAS body and the surface T of the BOAS body is between 37.5 mm to 37.9 mm.

7. The blade outer air seal (BOAS) of claim 1, wherein the radius of the curvature of the arc W of the BOAS body is between 254.0 mm to 259.1 mm.

8. The blade outer air seal (BOAS) of claim 7, wherein the radius of the curvature of the arc W of the BOAS body is between 257.8 mm and 258.6 mm.

9. A blade outer air seal (BOAS) for a gas turbine engine, comprising:

a BOAS body including a plurality of cooling holes defined in conformance with a second set of Cartesian coordinates as set forth in Table 2, wherein the second set of Cartesian coordinates are provided with respect to a point P2 which is at a center of curvature of an arc F of the BOAS body, wherein a Z axis of the second set of Cartesian coordinates is directed toward the center of a curvature of the arc of the BOAS body and a Y axis of the second set of Cartesian coordinates is directed toward a surface G of the BOAS body, wherein a measurement x2 in an X direction of the second set of Cartesian coordinates is normalized by a Y distance between the surface G of the BOAS body and a surface E of the BOAS body, wherein a measurement y2 in a Y direction of the second set of Cartesian coordinates is normalized by the Y distance between the surface G of the BOAS body and the surface E of the BOAS body, and wherein a measurement z2 in a Z direction of the second set of Cartesian coordinates is normalized by a radius of the curvature of the arc F of the BOAS body.

10. The blade outer air seal (BOAS) of claim 9, wherein the surface E is a first surface of the BOAS body.

11. The blade outer air seal (BOAS) of claim 9, wherein the surface G is a second surface of the BOAS body and is opposite the surface E of the BOAS body.

12. The blade outer air seal (BOAS) of claim 9, wherein the arc F of the BOAS body is adjacent to the surface C of the BOAS body.

13. The blade outer air seal (BOAS) of claim 9, wherein the Y distance between the surface G of the BOAS body and the surface E of the BOAS body is between 30.5 mm to 33.0 mm.

14. The blade outer air seal (BOAS) of claim 13, wherein the Y distance between the surface G of the BOAS body and the surface E of the BOAS body is between 31.3 mm to 31.6 mm.

15. The blade outer air seal (BOAS) of claim 9, wherein the radius of the curvature of the arc F of the BOAS body is between 254.0 mm and 264.2 mm.

16. The blade outer air seal (BOAS) of claim 15, wherein the radius of the curvature of the arc F of the BOAS body is between 258.8 mm and 259.5 mm.

17. A gas turbine engine, comprising:

a turbine section including a plurality of blade outer air seals (BOAS) disposed therein, the BOAS including a BOAS body including a plurality of cooling holes defined in conformance with a set of Cartesian coordinates as set forth in at least one of Table 1 and Table 2;

wherein for Table 1 a first set of Cartesian coordinates are provided with respect to a point P1 which is at a center of curvature of an arc W of the BOAS body, wherein a Z axis of the first set of Cartesian coordinates is directed toward the center of a curvature of the arc W of the BOAS body and a Y axis of the first set of Cartesian coordinates is directed away from a surface T of the BOAS body, wherein a measurement x1 in an X direction of the first set of Cartesian coordinates is normalized by a Y distance between a surface V of the BOAS body and a surface T of the BOAS body, wherein a measurement y1 in a Y direction of the first set of Cartesian coordinates is normalized by the Y distance between the surface V of the BOAS body and the surface T of the BOAS body, and wherein a measurement z1 in a Z direction of the first set of Cartesian coordinates is normalized by a radius of the curvature of the arc W of the BOAS body;

wherein for Table 2 a second set of Cartesian coordinates are provided with respect to a point P2 which is at a center of curvature of an arc F of the BOAS body, wherein a Z axis of the second set of Cartesian coordinates is directed toward the center of a curvature of the arc of the BOAS body and a Y axis of the second set of Cartesian coordinates is directed toward a surface G of the BOAS body, wherein a measurement x2 in an X direction of the second set of Cartesian coordinates is normalized by a Y distance between a surface G of the BOAS body and a surface E of the BOAS body, wherein a measurement y2 in a Y direction of the second set of Cartesian coordinates is normalized by the Y distance between the surface G of the BOAS body and the surface E of the BOAS body, and wherein a measurement z2 in a Z direction of the second set of Cartesian coordinates is normalized by a radius of the curvature of the arc F of the BOAS body.

18. The gas turbine engine of claim 17, wherein the turbine section includes at least one BOAS having cooling holes defined in at accordance with Table 1, and at least one BOAS having cooling holes defined in at accordance with Table 2.

19. The gas turbine engine of claim 18, wherein the at least one BOAS having cooling holes defined in at accordance with Table 1 is disposed in a first stage of the turbine section.

20. The gas turbine engine of claim 19, wherein the at least one BOAS having cooling holes defined in at accordance with Table 2 is disposed in a second stage of the turbine section aft of the first stage.

* * * * *